US008698427B2

(12) United States Patent
Dari et al.

(10) Patent No.: US 8,698,427 B2
(45) Date of Patent: Apr. 15, 2014

(54) MODULE TO CONTROL THE SUPPLY TO LED ASSEMBLIES

(75) Inventors: Alain Dari, Fontenay-Sous-Bois (FR); Loic Flandre, Saint-Maur-des-Fosses (FR); Sylvain Yvon, Paris (FR)

(73) Assignee: Valeo Vision, Bobigny (FR)

( * ) Notice: Subject to any disclaimer, the term of this patent is extended or adjusted under 35 U.S.C. 154(b) by 207 days.

(21) Appl. No.: 13/105,402

(22) Filed: May 11, 2011

(65) Prior Publication Data

US 2011/0279058 A1 Nov. 17, 2011

(30) Foreign Application Priority Data

May 12, 2010 (FR) ..... 10 53738

(51) Int. Cl.
*H05B 37/02* (2006.01)

(52) U.S. Cl.
USPC ..... 315/308; 315/291; 315/186

(58) Field of Classification Search
USPC ..... 315/307–311, 291, 306, 186
See application file for complete search history.

(56) References Cited

U.S. PATENT DOCUMENTS

| | | | | |
|---|---|---|---|---|
| 6,897,623 | B2 | 5/2005 | Yoneda et al. | |
| 6,975,214 | B2 * | 12/2005 | Schleicher | 340/435 |
| 7,015,654 | B1 * | 3/2006 | Kuhlmann et al. | 315/291 |
| 7,259,522 | B2 | 8/2007 | Toyota et al. | |
| 7,871,187 | B2 | 1/2011 | Flandre et al. | |
| 7,902,771 | B2 * | 3/2011 | Shteynberg et al. | 315/307 |
| 2004/0056774 | A1 | 3/2004 | Schleicher | |
| 2004/0090189 | A1 | 5/2004 | Yoneda et al. | |
| 2005/0062445 | A1 | 3/2005 | Toyota et al. | |
| 2007/0247305 | A1 | 10/2007 | Flandre et al. | |

FOREIGN PATENT DOCUMENTS

| | | | |
|---|---|---|---|
| EP | 1244334 | A2 | 9/2002 |
| EP | 1411750 | A2 | 4/2004 |
| EP | 1517588 | A1 | 3/2005 |
| EP | 1848249 | A1 | 10/2007 |

* cited by examiner

*Primary Examiner* — James H Cho
(74) *Attorney, Agent, or Firm* — Jacox, Meckstroth & Jenkins

(57) ABSTRACT

A device for measurement of characteristic parameters of at least one assembly of at least one light emitting diode (LED) comprising a measurement circuit for each assembly, wherein the measurement circuit has an electrical input which can be connected to the LED, a single measurement output to provide electrical values which are representative of at least two characteristic parameters of the LED, a first circuit configuration, which is designed to provide the measurement output with a value which is representative of a first characteristic parameter, a second circuit configuration, which is designed to provide the measurement output with a value which is representative of a second characteristic parameter and means for switching between the first circuit configuration and the second circuit configuration.

29 Claims, 6 Drawing Sheets

MODULE TO CONTROL THE SUPPLY TO LED ASSEMBLIES

CROSS-REFERENCE TO RELATED APPLICATIONS

This application claims priority to French Application No. 1053738 filed May 12, 2010, which application is incorporated herein by reference and made a part hereof.

BACKGROUND OF THE INVENTION

1. Field of the Invention

The field of the present invention is that of motor vehicle lighting. In general, the invention relates to a lighting system which is based on light emitting diodes, or LEDs. More specifically, the invention relates to a device for measurement of characteristics parameters of a light emitting diode. The invention also relates to a module to control the electrical supply to this diode, and its method.

A light emitting diode (or LED) is an electronic component which can emit light when an electric current passes through it. Significant advances have made possible major new applications such as in lighting, including in motor vehicle lighting. In fact the diodes can be used to provide light, and this is one of the headlight technology applications which is continually being developed.

2. Description of the Related Art

Certain vehicles are therefore now equipped with light emitting diodes of this type. Typically, the LEDs can be organized into assemblies, with each assembly of LEDs fulfilling at least one lighting function, such as high-beam or low-beam lights, for example.

The current of the LEDs must be controlled, in other words the control circuit of the LEDs must be able to define the current which passes through them, independently of the number of LEDs placed in series. In addition, the relationship which associates the voltage and supply current of the LEDs is not linear. Thus, a small increase in voltage applied to the LED can give rise to a substantial increase in the current, and therefore in the flow of light.

More importantly, an excessive increase in the voltage at the terminals of the LEDs gives rise to an excessively great passage of current, which can damage the component.

It is therefore essential to have a system to control the supply to the LEDs in order to control the flow of light, and generate the variation of the flow of the LEDs (dimming).

For this purpose, the conventional control system is often an LED driver. This component, which controls the supply to the LEDs on the basis of functioning parameters, in general requires the present of measurement means (in particular in order to avoid excessive heating of the LEDs), which consist of a complex circuit, normally with at least one inductor, capacitors, one or more diodes, a plurality of different power transistors, and resistors, for each assembly of LEDs.

Consequently, these known control circuits comprise complicated circuits and/or a plurality of quite complex electrical components.

SUMMARY OF THE INVENTION

One objective of the invention includes elimination of at least some of the disadvantages which are present in the prior art, by proposing a control module which has a device for measurement of characteristic parameters of light emitting diodes, which is less cumbersome and less complex than the solutions proposed by the prior art, and consequently provides a control module which is less cumbersome and less complex.

One embodiment of the invention relates firstly to a device for measurement of characteristic parameters of at least one assembly of at least one light emitting diode (LED) including a measurement circuit comprising the following for each assembly:

- a single measurement output to provide electrical values which are representative of at least two characteristic parameters of the assembly;
- a first circuit configuration, which is designed to provide the measurement output with a value which is representative of a first characteristic parameter;
- a second circuit configuration, which is designed to provide the measurement output with a value which is representative of a second characteristic parameter; and
- means for switching between the first configuration and the second configuration.

The invention thus proposes a very compact measurement device, which can measure two or more parameters of an assembly of light emitting diodes with a single circuit which has different configurations.

According to one embodiment, the characteristic parameters of the assembly of LEDs can comprise the resistor BIN. The value of this resistor is associated with the flow performance of a given LED or an assembly of LEDs of a given type, according to the current which passes through. This value allows a module to control the supply to the LED(s) to determine for example which given LED is involved, and what performance levels are associated with it. The module can thus adapt the supply current to the LED, in order to obtain the flow of light required in the lighting and/or signalling device which contains this LED.

According to another embodiment, the characteristic parameters of the LED(s) can comprise the temperature, and adaptation is carried out according to the latter. Thus, the current is lowered if the temperature is too high, or if the flow of an LED is too high in cold conditions.

A possibility for switching means consists of using transistors. One example consists of controlling the transistors by means of the application of a signal. For example, the transistors can be field-effect transistors with a metal oxide-semiconductor structure, which are also known as MOSFETs (Metal Oxide Semiconductor Field Effect Transistors). A MOSFET is a transistor comprising three electrodes which are known respectively as the drain, source and gate. The MOSFET can modulate the current which passes through it from the drain towards the source, by means of a signal which is applied to its central electrode, i.e. the gate. Thus, according to a variant of the invention, the MOSFET transistors are controlled by means of application of a signal to their gate. In combination with one or more transistors or alternatively, the switching means can comprise switches which carry out the open/closed function of parts of circuits which make it possible to switch from one circuit configuration to another.

According to one possible embodiment, pull-up resistors are used.

According to one embodiment, the device for measurement of characteristic parameters of at least one assembly of LEDs can comprise means for triggering the switching means.

The triggering means are advantageously configured in order to place a first switching means in the closed mode, whilst maintaining a second switching means in the open mode, with the switching from one circuit configuration to the other being carried out by inverting the closed mode and the open mode of the two switching means.

These triggering means can be configured to trigger periodically at least one of the parameter measurements. More particularly, and according to another embodiment, the triggering means are configured to trigger the measurement of at least one parameter periodically, and/or at each time the assembly of LEDs is supplied with electricity. This parameter can be the BIN value which is associated with an LED.

The switching means can be automated according to a predefined interval of time, and configured such as to create in succession at least two configurations of the circuit.

An advantage of the presence of switching means, which are preferably associated with triggering means, is that it is possible to switch from one measurement configuration to another one immediately and according to a predetermined functioning plan, in particular with a given period of acquisition and triggering of one measurement or another at certain moments (such as when switching on) of functioning of the LEDs.

According to another embodiment, the measurement circuit can comprise a single transistor and a single analog/digital converter.

The device for measurement of characteristic parameters can comprise at least two parallel circuits which have common triggering means, in order to measure parameters of a plurality of LED assemblies. According to a preferred embodiment, the device comprises a plurality of circuits which are substantially identical and parallel.

The last variants show that the invention provides great flexibility of application, since the number of LED assemblies is not limited, and even with several LED assemblies, the device is economical in terms of the number of components.

The present invention also relates to a module to control the electrical supply of at least one assembly of LEDs which comprises the above-described measurement device. Since the device is less cumbersome and less complex than the solutions according to the prior art, the control module is logically also less cumbersome and less complex.

According to one embodiment, the module to control the electrical supply of at least one assembly of LEDs can comprise means for regulation of the supply according to electrical values which are representative of the characteristic parameters of the LEDs.

The invention also relates to a lighting system comprising at least one assembly of light emitting diodes (LEDs) and the above-described control module.

Finally, the invention relates to a method for control of the supply to at least one assembly of light emitting diodes (LEDs) comprising:

i) the formation of a circuit for measurement of the characteristic parameters of the assembly with a measurement output;

ii) the following measurement steps:

connecting the assembly to an input of the measurement circuit;

forming a first circuit configuration in order to provide the measurement output with a value which is representative of a first characteristic parameter;

forming a second circuit configuration in order to provide the measurement output with a value which is representative of a second characteristic parameter;

switching between the first and second configurations; and iii) control of the current of at least one LED of the assembly according to the characteristic parameters.

The invention and its different applications will be better understood by reading the following description and examining the accompanying figures. The latter are provided purely by way of non-limiting indication of the invention.

BRIEF DESCRIPTION OF THE ACCOMPANYING DRAWINGS

DETAILED DESCRIPTION OF THE PREFERRED EMBODIMENTS

Figure 1:
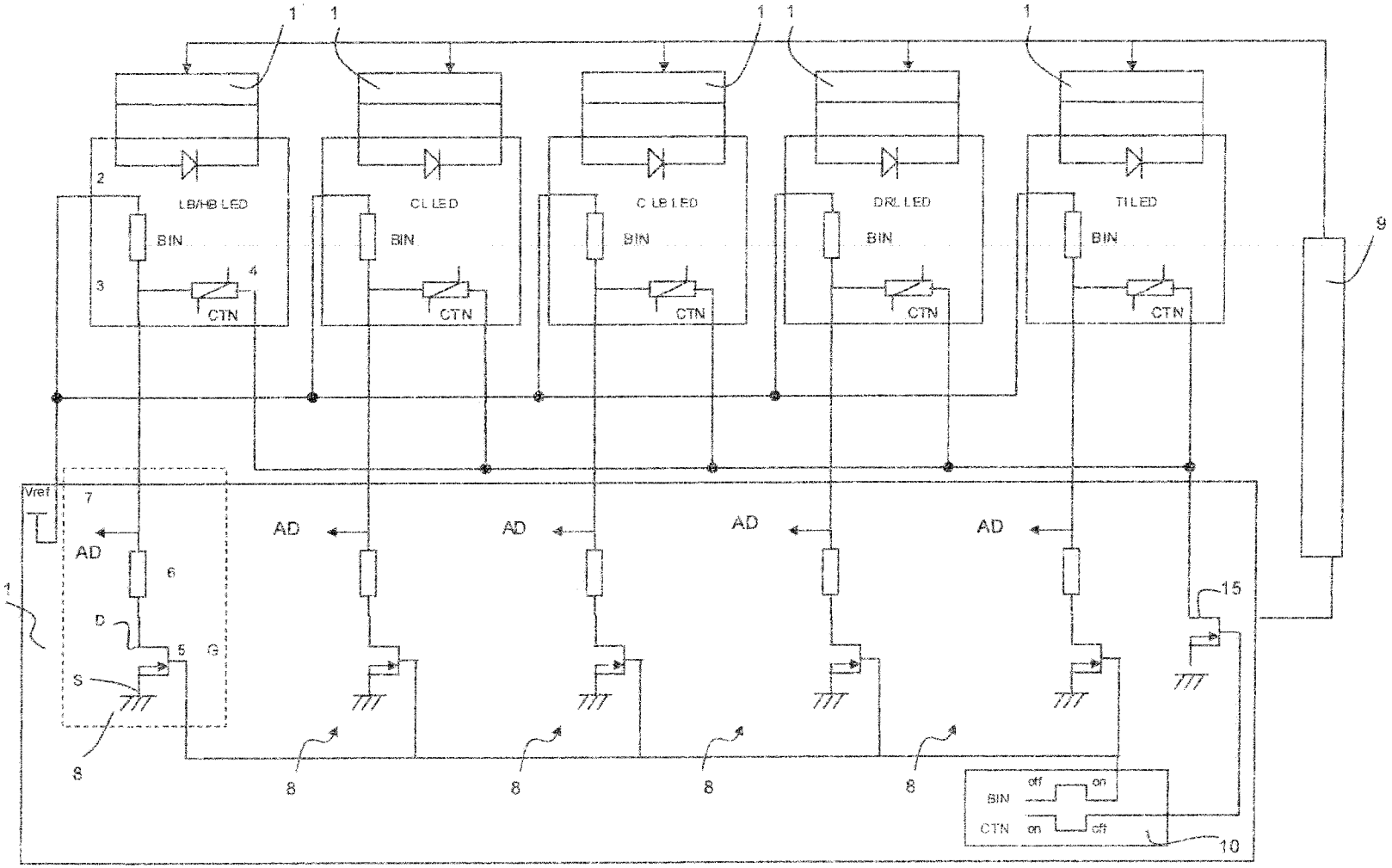
FIG. 1 represents schematically a device for measurement of characteristic parameters of a plurality of assemblies of light emitting diodes according to the invention.

FIG. 1 shows a measurement device 1 which is connected electrically to a plurality of assemblies of different Light Emitting Diodes. From left to right, FIG. 1 shows an assembly of at least one LED for a dual function HB/LB (HB/LB for High Beam/Low Beam) module for the high-beam/low-beam function. This assembly is schematized with an LED symbol. For example, it advantageously comprises a plurality of LEDs, such as two LEDs in order to carry out the low-beam function, and one LED in order to carry out the complementary high-beam function. An assembly of at least one LED for side lighting CL LED (CL for Corner Light) is then shown for lighting of the sides, an assembly of at least one LED, CLB LED (CLB for Complementary Low Beam) for complementary lighting in low-beam mode, an assembly of at least one LED, DRL LED (DRL for Day Running Light) for a daytime position light, and an assembly of at least one LED, TI LED (TI for Turn Indicator), for the change of direction indicator. These five assemblies of LEDs which carry out five diode functions are shown purely by way of indication, and are not exhaustive.

An assembly of diodes which comprises at least one diode of a given type, and generally a plurality of diodes, can be associated with a resistor BIN and a thermistor CTN. The connections of the diodes are not shown, in order to simplify the figures. The resistor BIN and the thermistor CTN are in series, as illustrated in FIG. 1. In order to facilitate understanding of the figures, the diodes, the regulation block 9 and the control 10 of the switches are shown only in FIG. 1.

A measurement circuit 8 is associated with an assembly of diodes. The measurement device 1 which is proposed can thus comprise a plurality of measurement circuits 8. This is the case which applies in the illustrations.

A reference voltage Vref is applied to each measurement circuit simultaneously. More specifically, the reference voltage Vref is applied to the resistor BIN of each assembly of at least one diode at the node 2.

The reference voltage Vref can be produced in the measurement device, or it can be a reference voltage which is external to the measurement device.

The measurement device is connected electrically to the electric circuit of the corresponding assembly of LEDs, at the thermistor CTN at the node 3, which represents a connection point between BIN and CTN.

More specifically, for each assembly of LEDs, the node 3 for connection between the resistor BIN and the thermistor CTN is connected to a measurement circuit 8 of the device 1. This circuit 8 comprises a resistor 6, which is connected to the drain D of a transistor 5, which in this example is a MOSFET. The source S of the transistor 5 is connected to earth. The node 3 for connection between the resistor BIN and the thermistor CTN is connected to the free end of the resistor 6, at node 7. All of these circuits 8 are connected at the gates G of the transistors 5. For each assembly of diodes which is connected to a circuit 8, an AD (analog digital) converter is placed at node 7 for connection between the resistor 6 and the node 3 for connection between the resistor BIN and the thermistor CTN.

However, the free ends of the thermistors CTN of the LEDs, i.e. the nodes 4, are connected together and to the drain D of a single transistor 15, the source S of which is connected to earth.

It should be noted that FIG. 1 shows the use of a plurality of transistors (references 5 and 15) in order to apply modifications of circuit configurations. The choice of transistors for this function is purely indicative, and any means for changing the configuration of the circuit comes within the scope of the invention.

FIG. 1 also shows triggering means 10 which can control the switching of the transistors (or other functionally equivalent means). The means 10 can comprise means for application of an electrical supply at gate G of the transistor 15, according to a binary command which is illustrated by the terms ON-OFF. Subsequently, the circuit variations thus produced are described in detail. Similarly, the triggering means 10 can comprise means for application of an electrical supply at gate G of the transistors 5. It will be seen with reference to FIG. 2 in particular that at different moments there is activation of the means for application of a supply to the transistors 5 and 15.

FIG. 1 also illustrates for each assembly of LEDs a supply which can be of the conventional type, in order to apply the necessary current to the LEDs.

The supplies 8 are each controlled by a command provided by the regulation means 9, using the values of the parameters obtained from the measurement circuits 8. For example, the regulation means make it possible to apply re-checking of the supply current of an assembly of LEDs, the BIN of which has been determined, according to the temperature value obtained from the measurement which uses the thermistor CTN.

A description in greater detail is provided hereinafter of the measurement of the BIN and CTN parameters, and of the circuit configurations which permit these measurements.

Figure 2:
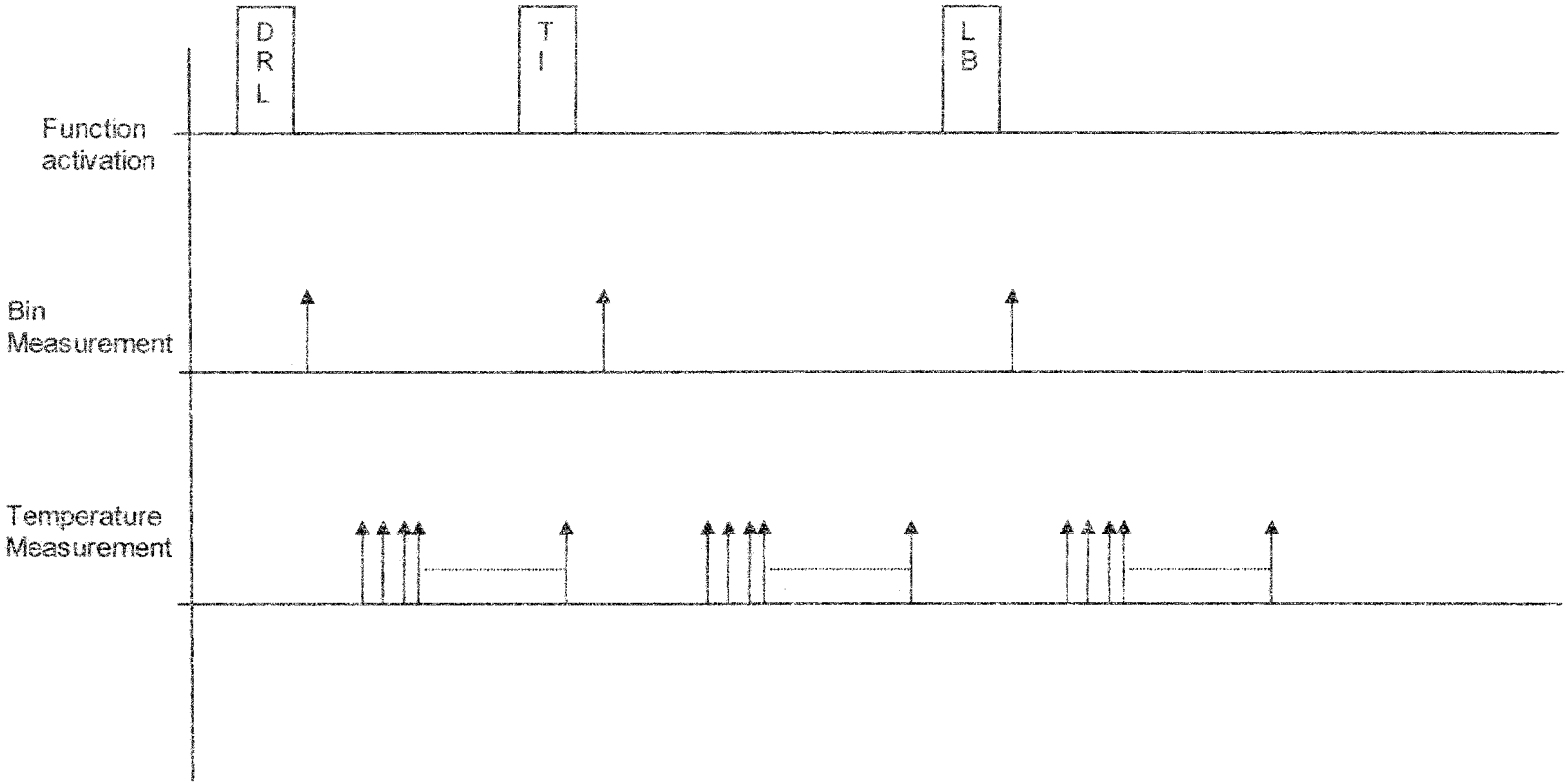
FIG. 2 represents a diagram which shows the cycle of the measurements according to the activation of the diodes in accordance with an embodiment of the invention.

It is important to measure the value of the resistor BIN of each assembly of at least one LED, in order to determine the current which needs to be applied to the LED. The value of BIN is a code which describes the technical characteristics of an LED briefly and simply. The characteristics which the BIN defines can include the color, shade, flow and inverse voltage. Within the context of the invention, the BIN value means any code which makes it possible to sort and characterize LEDs. The resistor BIN varies from one LED assembly to another. The BIN of each LED is consequently measured independently. The BIN of an LED is fixed. An initial measurement should thus be sufficient. However, a user of the system can replace a LED or an assembly of LEDs by another one for different reasons, for example if it is defective, or if there is a new need to determine the value of the BIN when a change of driver takes place. A further BIN measurement must then take place. Thus, as illustrated in FIG. 2, a BIN measurement is made at each supply/activation of an LED. Whenever necessary, the triggering means 10 apply a signal to the gate G of the transistors 5. The circuit configuration obtained is that in FIG. 3.

FIG. 2 also shows the measurements of the thermistor CTN, which represent the temperature of the LED. The means 10 apply a signal to the gate G of the transistor 15, thus obtaining the configuration in FIG. 4.

These measurements are continuous or more frequent measurements, which are interrupted only by a BIN measurement, since a BIN measurement and a CTN measurement cannot be made simultaneously. All the measurements are advantageously made automatically according to predefined and/or adjustable intervals of time, or are triggered by external events such as the supply to the LED assembly.

In the case in FIG. 2, events trigger the measurements of BIN values. This is the case for activation of initialization of the control of the LEDs, which generally takes place when the power is switched on. In FIG. 2, an event is indicated as DRL for an assembly of LEDs associated with the daytime position light or DRL, TI for an assembly of LEDs associated with the change of direction indicator, and finally LB for an assembly of LEDs associated with the low-beam light. A change of LEDs, of control, or another event can also trigger this measurement of the value of BIN.

Preferably, the temperature measurement is carried out most often, for example at a predetermined frequency, in the time intervals which are situated between two BIN measurements.

Figure 3:
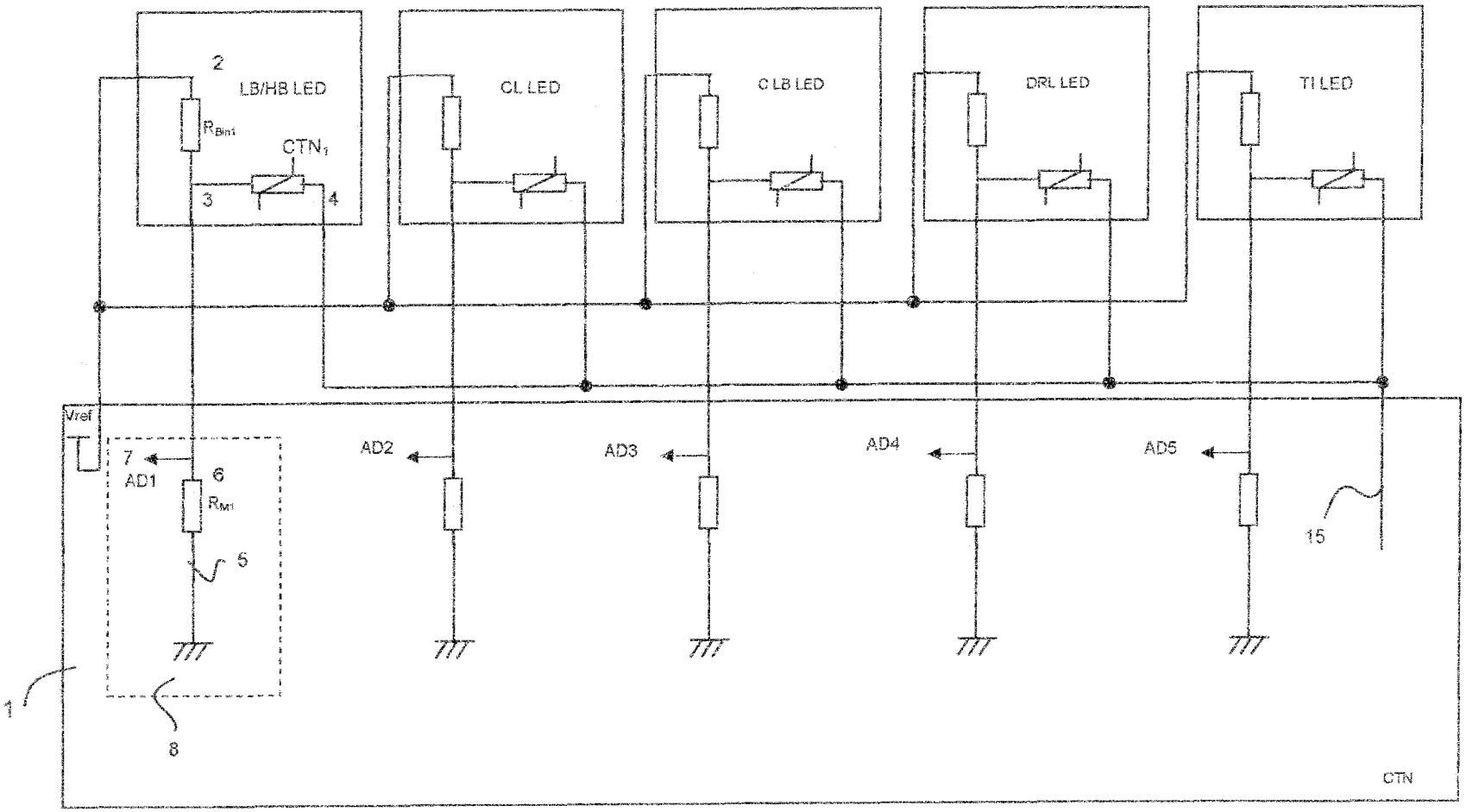
FIG. 3 represents schematically a device for measurement of characteristic parameters of assemblies of light emitting diodes according to the invention in a first configuration.

FIG. 3 shows a first configuration of the device 1 for measurement of the resistor BIN for Light Emitting Diodes. For each diode, it is advantageous to determine the resistance of the LED Rbin-i.

In this configuration, the transistors are switched such that they are equivalent to a simple circuit connection. The transistor 15 is equivalent to an open circuit.

It is thus possible to measure the value ADi at node 7, and calculate the resistance Rbin-i according to the principle of a voltage divider represented by the equation:

$$ADi = Vref \cdot (RMi/(RMi+Rbin\text{-}i))$$

where

RMi represents the value of the resistor 6;

Rbin-i represents the value of the resistor BIN; and i is the index associated with the LED for which the measurement is carried out.

By taking the assembly of diodes of the LB/HB LEDs situated in the left in FIG. 3 by way of example, it is determined that i=1. The indices 2, 3, 4 and 5 are attributed respectively to the assemblies of LEDs which are associated with the low-beam/high-beam function LB/HB, the lighting function which is secured to the sides CL, the complementary lighting in the low-beam light mode CLB, the function of the daytime position light DRL, and the function for signalling of change of direction TI.

Figure 4:
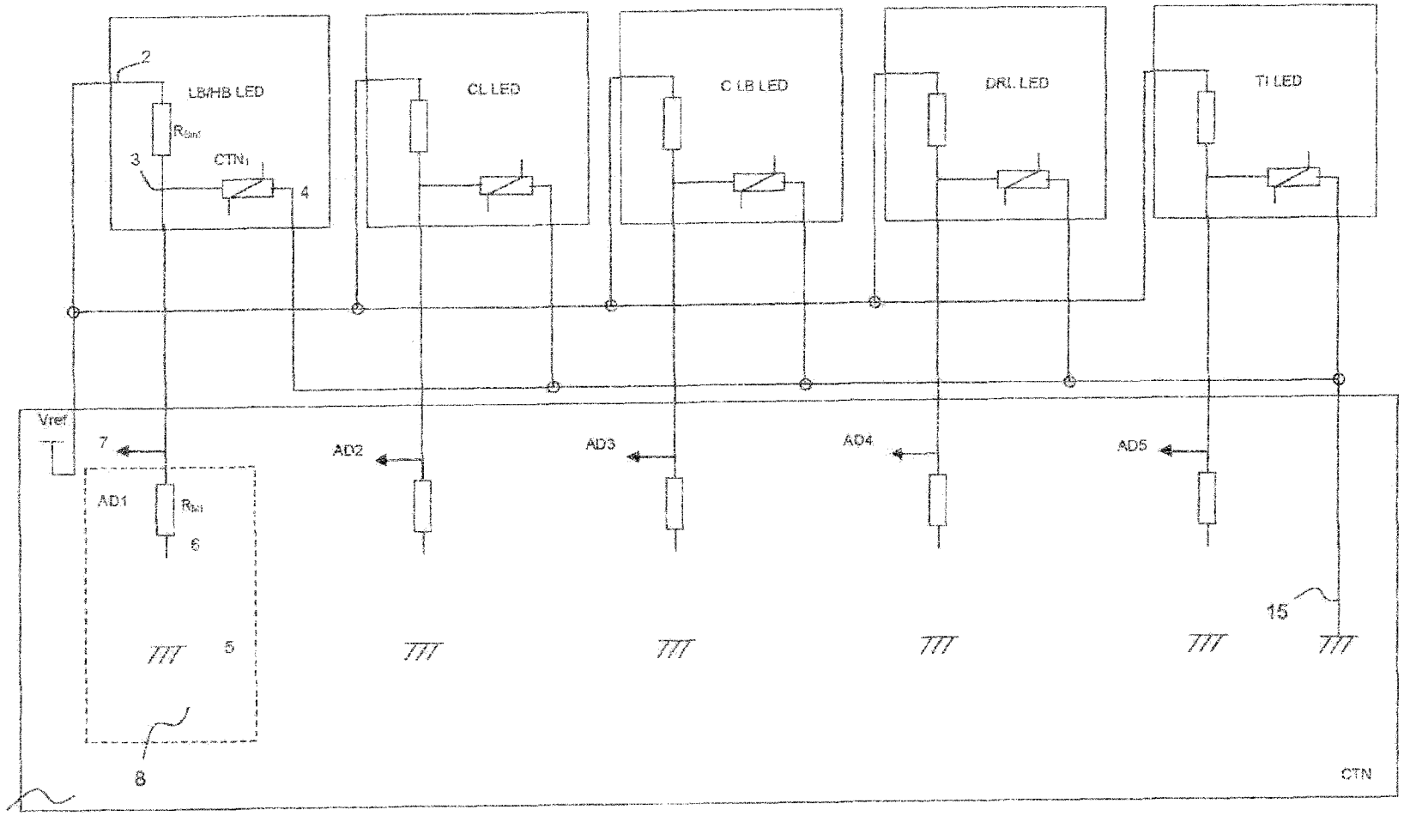
FIG. 4 represents schematically a device for measurement of characteristic parameters of assemblies of light emitting diodes according to the invention in a second configuration.

FIG. 4 shows a second configuration of the device for measurement of the thermistor CTN for Light Emitting Diodes. By always taking the assembly of diodes associated with the low-beam/high-beam function LB/HB LED situated on the left in FIG. 4 by way of example, it is attempted to determine the temperature of this assembly by identifying CTN1. By switching the transistors to this second position, the transistor 15 is equivalent to a simple circuit connection, whereas the transistors 5 form open circuits. Other switching means could be used.

It is thus possible to measure the value ADi, for example AD1, at the same node 7, and to carry out the calculation for the thermistor CTN1 or the LB/HB LED according to the principle of a voltage divider which is represented by the equation:

$$ADi = Vref \cdot (CTNi/(CTNi + Rbin\text{-}i))$$

where

CTNi represents the value of the thermistor CTN;

Rbin-i represents the value of the resistor BIN; and i is the index associated with the LED for which the measurement is carried out. By taking the assembly of diodes of the HB/LB LEDs situated in the left in FIG. 3 by way of example, it is determined that i=1. The indices 2, 3, 4 and 5 are attributed respectively to the assemblies of LEDs which are associated with the low-beam/high-beam function LB/HB, the lighting function which is secured to the sides CL, the complementary lighting in the low-beam light mode CLB, the function of the daytime position light DRL, and the function for signalling of change of direction TI.

By switching the transistors of the measurement device, and by always measuring the same output (nodes 7), it is possible to measure two different characteristic parameters of an LED by means of a simple device, thus limiting the number of components. In addition, instead of having a measurement circuit for the resistors BIN and a measurement circuit for the thermistors, the present invention makes it possible to have a single measurement circuit. The number of connections to components which are associated with the LED in a measurement module is thus reduced, thereby simplifying its design and its cost.

The invention is thus a particular advantage in a device comprising a plurality of LEDs, and in particular within the context of a vehicle lighting device, such as a headlight, comprising a plurality of LEDs which are assigned to different lighting and/or signalling functions.

Figure 5A:
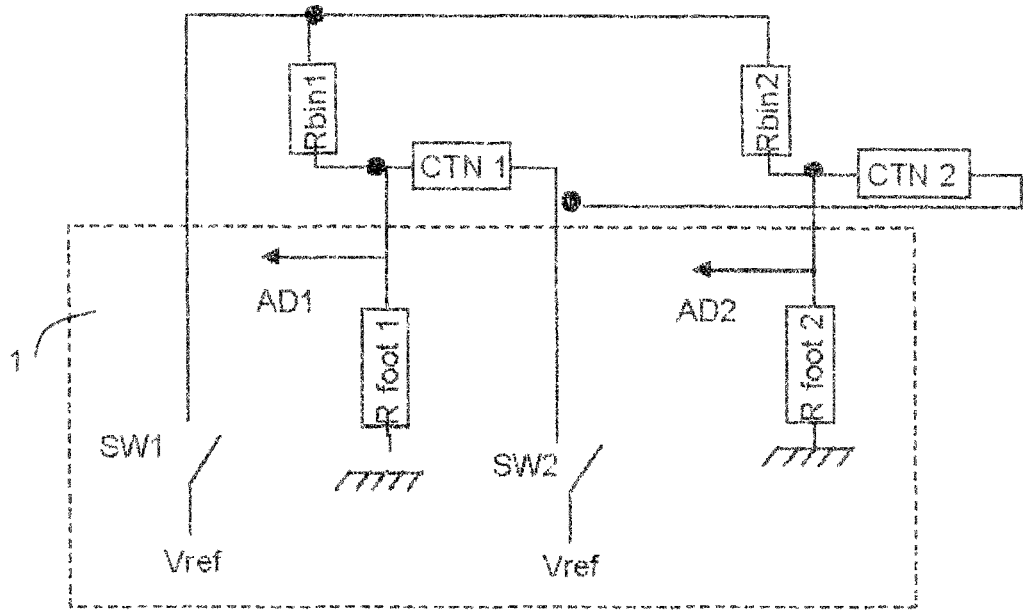
FIGS. 5A and 5B represent schematically a device for measurement of characteristic parameters of assemblies of light emitting diodes according to the invention in a second and third embodiment.
Figure 5B:
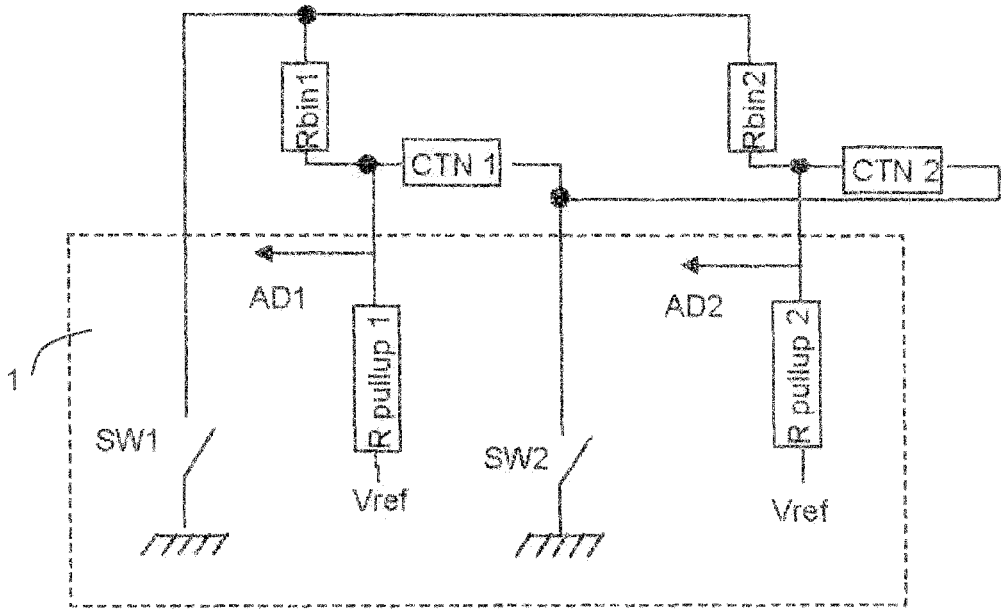

FIGS. 5A and 5B show two other possibilities of implementation of the invention with measurement circuits which use switching by means of switches.

FIG. 5A shows two switches SW1 and SW2 which are introduced into the circuit of the measurement device 1. When thus arranged, two switches are sufficient for a measurement device 1, irrespective of the number of measurement circuits 8, i.e. the number of BINs and CTNs, or of LED assemblies.

By way of example, for five assemblies of LEDs, there are also only five footing resistors and seven connection points or pins (2 Vref inputs and 5 AD outputs).

The resistors R foot 1 and R foot 2 are connected to earth, whereas the switches SW1 and SW2 make it possible alternatively to apply a voltage Vref. The switching is always carried out by triggering means 10.

On the basis of SW1, it is possible to read the value Rbin, whereas the CTN reading takes place by means of SW2. Thus, the CTN reading is independent from the BIN reading.

FIG. 5B shows a possible improvement in the precision of measurement of the embodiment shown in FIG. 5A. Thus, the resistors R pullup 1 and R pullup 2, which are also known as pull-up resistors, are subjected to a voltage Vref, whereas the switches SW1 and SW2 are connected to earth.

Whilst keeping the switch SW2 open, closure of the switch SW1 makes it possible to read the resistors BIN, $Rbin_1$, $Rbin_2$ in a manner similar to the preceding cases at points $AD_1$ and $AD_2$, With the combination of the switch SW1 open and SW2 closed, the value of the thermistors CTN1 and CTN2 is determined at the outputs $AD_1$ and $AD_2$.

It will be noted that, in the example in FIG. 5A, the measurement of the resistors $CTN_i$ takes place independently of the values of the resistors $Rbin_i$. This additionally applies in FIG. 5B, and also in this figure in relation to the connections of $Rbin_i$ and $CTN_i$ to earth by means of the switches SW1 and SW2.

The invention is not limited to the above-described examples, but extends to any embodiment which is in conformity with its spirit.

While the method herein described, and the form of apparatus for carrying this method into effect, constitute preferred embodiments of this invention, it is to be understood that the invention is not limited to this precise method and form of apparatus, and that changes may be made in either without departing from the scope of the invention, which is defined in the appended claims.

What is claimed is:

1. A measurement device for measurement of characteristic parameters of at least one assembly of at least one light emitting diode (LED), comprising a measurement circuit for each assembly, wherein said measurement circuit comprises:

a single measurement output to provide electrical values which are representative of at least two characteristic parameters of said at least one assembly;

a first circuit configuration, which is designed to provide the measurement output with a value which is representative of a first characteristic parameter of a first operational characteristic of said at least one LED;

a second circuit configuration, which is designed to provide the measurement output with a value which is representative of a second characteristic parameter of a second operational characteristic of said at least one LED, wherein said second operational characteristic is different from said first operational characteristic; and means for switching between said first circuit configuration and said second circuit configuration;

wherein said first operational characteristic is an electrical value associated with said at least one LED and said second operational characteristic is a temperature associated with said at least one LED.

2. The measurement device according to claim 1, wherein said first operational characteristic comprises the value BIN.

3. The measurement device according to claim 1, wherein said second operational characteristic comprises a temperature of said at least one LED.

4. The measurement device according to claim 3, wherein a first operational characteristic comprises the value BIN.

5. The measurement device according to claim 1, comprising means for triggering of switching means.

6. The measurement device according to claim 5, wherein said triggering means are configured to trigger periodically measurement of at least one of said characteristic parameters.

7. The measurement device according to claim 5, wherein said triggering means are configured to trigger the measurement of at least one of said characteristic parameters each time said assembly is supplied with electricity.

8. The measurement device according to one claim 1, wherein said switching means are automated according to a predefined interval of time, and are configured such as to create in succession at least two configurations of the circuit.

9. The measurement device according to claim 1, comprising a plurality of assemblies of at least one LED, and a plurality of measurement circuits.

10. The measurement device according to claim 9, wherein said plurality of measurement circuits are in parallel and have common triggering means.

11. A module to control the electrical supply of at least one assembly of at least one light emitting diode (LED) comprising the device according to claim 1.

12. A lighting system comprising at least one assembly of at least one light emitting diode (LED) and a control module according to claim 11.

13. The measurement device according to claim 1, wherein a value of a resistor is associated with a flow performance of said at least one LED or an assembly of LEDs of a given type, according to a current which passes through.

14. The measurement device according to claim 1, wherein said first operational characteristic is associated with a flow performance of said at least one LED according to a current which passes through it.

15. A measurement device for measurement of characteristic parameters of at least one assembly of at least one light emitting diode comprising a measurement circuit for each assembly, wherein the measurement circuit comprises:

a single measurement output to provide electrical values which are representative of at least two characteristic parameters of the assembly;

a first circuit configuration, which is designed to provide the measurement output with a value which is representative of a first characteristic parameter;

a second circuit configuration, which is designed to provide the measurement output with a value which is representative of a second characteristic parameter; and means for switching between said first circuit configuration and said second circuit configuration;

wherein said switching means comprise a transistor, and wherein said measurement circuit comprises an analogue/digital converter at the measurement output;

wherein said first operational characteristic is an electrical value associated with said at least one light emitting diode and said second operational characteristic is a temperature associated with said at least one light emitting diode.

16. A method to control the supply of at least one assembly of at least one light emitting diode (LED) comprising:

i) a step of formation of a circuit for measurement of characteristic parameters of said at least one assembly with a measurement output;

ii) the following measurement steps:

connecting said measurement circuit to a reference voltage;

connecting said at least one assembly of at least one light emitting diode to an input of said measurement circuit;

forming a first circuit configuration in order to provide said measurement output with a value which is representative of a first characteristic parameter of a first operational characteristic of said at least one LED;

forming a second circuit configuration in order to provide the measurement output with a value which is representative of a second characteristic parameter of a second operational characteristic of said at least one LED, wherein said second operational characteristic is different from said first operational characteristic;

switching between said first and second circuit configurations; and iii) a step of control of the current of at least one light emitting diode of said at least one assembly according to said characteristic parameters.

17. A measurement device for measurement of characteristic parameters of at least one assembly of at least one light emitting diode (LED), comprising a measurement circuit for each assembly, wherein said measurement circuit comprises:

a single measurement output to provide electrical values which are representative of at least two characteristic parameters of said at least one assembly;

a first circuit configuration, which is designed to provide the measurement output with a value which is representative of a first characteristic parameter of a first operational characteristic of said at least one LED;

a second circuit configuration, which is designed to provide the measurement output with a value which is representative of a second characteristic parameter of a second operational characteristic of said at least one LED, wherein said second operational characteristic is different from said first operational characteristic; and at least one switch for switching between said first circuit configuration and said second circuit configuration;

wherein said first operational characteristic is an electrical value associated with said at least one LED and said second operational characteristic is a temperature associated with said at least one LED.

18. The measurement device according to claim 17, wherein said first operational characteristic comprises the value BIN.

19. The measurement device according to claim 17, wherein said second operational characteristic comprises a temperature of said at least one LED.

20. The measurement device according to claim 17, comprising means for triggering said at least one switch.

21. The measurement device according to claim 20, wherein said triggering means are configured to trigger periodically measurement of at least one of said characteristic parameters.

22. The measurement device according to claim 20, wherein said triggering means are configured to trigger the measurement of at least one of said characteristic parameters each time said assembly is supplied with electricity.

23. The measurement device according to one claim 17, wherein said at least one switch is automated according to a predefined interval of time, and is configured such as to create in succession at least two configurations of said measurement circuit.

24. A measurement device for measurement of parameters of an assembly of one or more light emitting diodes (LEDs), comprising:

a) a thermistor (CTN) having a resistance which indicates temperature of said one or more LEDs;

b) a code resistor (BIN) having a resistance value which acts as a code to indicate one or more characteristics of said one or more LEDs;

c) a known resistor (6) having a known value;

d) a reference voltage (Vref); and e) a system of switches which 1) places said code resistor (BIN) in series combination with said known resistor (6), and places said reference voltage (Vref) across the series combination, to thereby create a voltage across said known resistor (6), which indicates the value of said code resistor (BIN).

25. The measurement device according to claim 24, in which said system of switches further 2) places said thermistor (CTN) in series combination with said code resistor (BIN), and places said reference voltage (Vref) across the series combination, to thereby create a voltage across said code resistor (BIN), which indicates the value of said thermistor (CTN), thereby indicating the temperature of said one or more LEDs.

26. The measurement device according to claim 25, and further comprising a control which regulates current through said one or more LEDs, based on the measured value of said code resistor (BIN) and the measured value of said thermistor (CTN).

27. A measurement device for measurement of parameters of an assembly of one or more light emitting diodes (LEDs), comprising:

a) a thermistor (CTN) having a resistance (RCTN) which indicates temperature of said one or more LEDs;

b) a code resistor (BIN) having a resistance (RBIN) which acts as a code to indicate one or more characteristics of said one or more LEDs; and c) a system which first deduces said resistance (RBIN) by reference to a known resistor (6) and then deduces said resistance (RCTN) by reference to said resistance (RBIN).

28. The measurement device according to claim 27, in which said resistance (RBIN) is ascertained by (A) placing said code resistor (BIN) in series with said known resistor (6).

29. A measurement device for measurement of parameters of an assembly of one or more light emitting diodes (LEDs), comprising:

a) a thermistor (CTN) having a resistance (RCTN) which indicates temperature of said one or more LEDs;

b) a code resistor (BIN) having a resistance (RBIN) which indicates characteristics of said one or more LEDs;

c) a system which (A) first deduces said resistance (RBIN) by drawing a current through said code resistor (BIN) and measuring voltage which that current produces in a known resistor (6) and then (B) deduces said resistance (RCTN) by drawing a current through said thermistor (CTN) and measuring a voltage which said current produces in said known resistor (6), (B) applying a known voltage to the series combination, (C) measuring voltage across said known resistor (6), and (D) computing said resistance (RBIN) based on voltage division principles.

* * * * *